US008443519B2

(12) United States Patent
Xu

(10) Patent No.: US 8,443,519 B2
(45) Date of Patent: May 21, 2013

(54) BLADE SUPPORTS FOR USE IN SHAVING SYSTEMS

(75) Inventor: Ming Laura Xu, Wayland, MA (US)

(73) Assignee: The Gillette Company, Boston, MA (US)

( * ) Notice: Subject to any disclaimer, the term of this patent is extended or adjusted under 35 U.S.C. 154(b) by 1325 days.

(21) Appl. No.: 11/521,819

(22) Filed: Sep. 15, 2006

(65) Prior Publication Data

US 2008/0066315 A1 Mar. 20, 2008

(51) Int. Cl.
*B26B 21/54* (2006.01)
*B41M 3/12* (2006.01)

(52) U.S. Cl.
USPC ..... 30/32

(58) Field of Classification Search
USPC ..... 30/32, 346.54, 346.55, 50; 76/119
See application file for complete search history.

(56) References Cited

U.S. PATENT DOCUMENTS

| | | | | |
|---|---|---|---|---|
| 3,635,811 | A | 1/1972 | Lane | |
| 3,829,969 | A | 8/1974 | Fischbein et al. | |
| 3,980,861 | A * | 9/1976 | Fukunaga | 219/230 |
| 4,492,845 | A | 1/1985 | Kljuchko et al. | |
| 4,720,918 | A | 1/1988 | Curry et al. | |
| 4,724,058 | A | 2/1988 | Morrison | |
| 4,933,058 | A | 6/1990 | Bache et al. | |
| 5,032,243 | A | 7/1991 | Bache et al. | |
| 5,037,522 | A | 8/1991 | Vergason | |
| 5,088,202 | A | 2/1992 | Boland et al. | |
| 5,129,289 | A | 7/1992 | Boland et al. | |
| 5,142,785 | A | 9/1992 | Grewal et al. | |
| 5,232,568 | A | 8/1993 | Parent et al. | |
| 5,279,723 | A | 1/1994 | Falabella et al. | |
| 5,295,305 | A | 3/1994 | Hahn et al. | |
| 5,458,754 | A | 10/1995 | Sathrum et al. | |
| 5,497,550 | A * | 3/1996 | Trotta et al. | 30/50 |
| 5,669,144 | A | 9/1997 | Hahn et al. | |
| 5,799,549 | A | 9/1998 | Decker et al. | |
| 5,857,260 | A * | 1/1999 | Yamada et al. | 30/346.51 |
| 5,940,975 | A | 8/1999 | Decker et al. | |
| 5,992,268 | A | 11/1999 | Decker et al. | |
| 6,289,593 | B1 | 9/2001 | Decker et al. | |
| 7,607,230 | B2 | 10/2009 | Aviza et al. | |
| 2004/0244539 | A1 * | 12/2004 | Korb et al. | 76/104.1 |
| 2005/0268470 | A1 * | 12/2005 | Skrobis et al. | 30/346.54 |
| 2006/0242844 | A1 * | 11/2006 | Skrobis et al. | 30/346.54 |
| 2007/0124939 | A1 * | 6/2007 | Van Eibergen Santhagens | 30/50 |

FOREIGN PATENT DOCUMENTS

| | | |
|---|---|---|
| EP | 0 207 467 A1 | 1/1987 |
| EP | 0 509 875 A1 | 10/1992 |
| JP | 109839 | 4/1989 |
| WO | WO 87/04471 | 7/1987 |
| WO | WO 93/09921 | 5/1993 |

* cited by examiner

*Primary Examiner* — Ghassem Alie
(74) *Attorney, Agent, or Firm* — Joanne N. Pappas; Kevin C. Johnson; Steven W. Miller

(57) ABSTRACT

Supported blades for use in shaving systems are disclosed. The supported blades include a blade support having a surface that is coated with aluminum. The aluminum coating is on a portion of an outer surface of the blade support or on the lower surface of the blade support or covering the entire lower surface of the blade support. The aluminum coating is less than 5 μm thick and is made of substantially pure aluminum. By providing aluminum coating, corrosion is prevented without the need for aluminum clips. The supported blades may be mounted in a blade unit housing without clips within a cartridge which can be mounted on a detachable or permanent handle of a shaving razor.

6 Claims, 1 Drawing Sheet

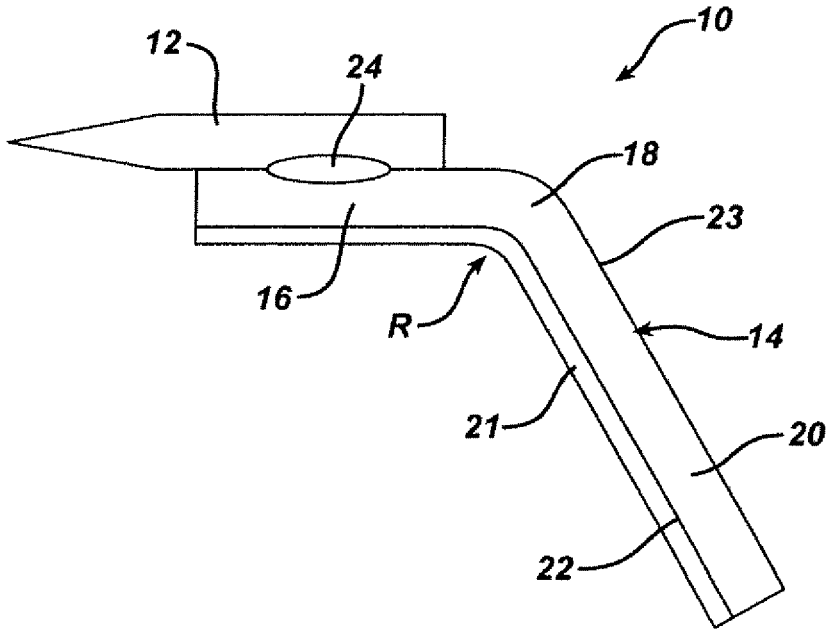
10
12
24
18
23
16
R
14
21
20
22

BLADE SUPPORTS FOR USE IN SHAVING SYSTEMS

TECHNICAL FIELD

The invention relates to blade supports for use in shaving systems.

BACKGROUND

In recent years shaving razors with various numbers of blades have been proposed in the patent literature and commercialized, as described, e.g., in U.S. Pat. No. 5,787,586, which generally describes a type of design that has been commercialized as the three-bladed Mach III razor by The Gillette Company. The blades of the Mach III razor are secured to a cartridge housing using aluminum clips. The clips extend over the blades and about the periphery of the housing. The blades are welded to stainless steel blade supports, which provide the blades with lateral support and which have ends that are retained by the clips, holding the blades securely in place in the cartridge.

The aluminum clips tend to function as the anode (preferentially corroded part) in the galvanic couple formed by the clips and blades/supports, thereby inhibiting corrosion of the steel blades and blade support. Thus, if the shaving razor is exposed to corrosive conditions, the clips will corrode and the shaving blades and trimming blade will function as a cathode that is protected from corrosion. This sacrificial function of the clips is advantageous because corrosion of the cutting edges of the blades could pose a safety hazard to the user, while corrosion of the clips will be aesthetically unattractive and will most likely prompt the user to discard the cartridge before further damage can take place. However, under some conditions corrosion of the blades and/or supports may still occur, for example if there is insufficient contact between the blades and clip. Moreover, it would be advantageous to be able to eliminate the aluminum clips in some cartridge designs.

SUMMARY

The inventor has found that, by providing an aluminum coating on the blade support(s), corrosion can be prevented without the need for aluminum clips. Moreover, if aluminum clips are used with the aluminum coated blade support(s), corrosion inhibition may be enhanced, for example when there is insufficient contact between the blade and clips for the clips to prevent corrosion.

In one aspect, the invention features a supported blade for use in a shaving system, the supported blade comprising: (a) a blade having a sharpened edge and a planar portion; and (b) a blade support having an upper surface and a lower surface, the planar portion of the blade being mounted to a surface of the upper surface of the blade support. The blade support has an aluminum coating on a portion of its outer surface, for example on the lower surface of the blade support. In some implementations, the coating covers the entire lower surface of the blade support.

Some implementations include one or more of the following features. The blade support includes an upper portion to which the planar portion of the blade is mounted, a lower portion, and a bent portion between the upper and lower portions. The aluminum coating is less than 5 μm thick. The blade support is formed of steel.

In another aspect, the invention features a shaving system comprising (a) a blade unit housing; and (b) within the housing, a supported blade assembly comprising (i) a blade having a sharpened edge and a planar portion; and (ii) a blade support having an upper surface and a lower surface, the planar portion of the blade being mounted to a surface of the upper surface of the blade support, and the blade support having an aluminum coating on a portion of its outer surface.

Some implementations include one or more of the following features. The shaving system further comprises a handle on which the blade unit housing is mounted. A plurality of supported blades are mounted within the housing. The supported blade is retained within the housing without clips. The blade unit housing is detachably mounted on the handle. Alternatively, the blade unit housing is permanently mounted on the handle, e.g., the housing is integrally molded with the handle. The coating is on the lower surface of the blade support. The coating covers the entire lower surface of the blade support.

In a further aspect, the invention features a method of manufacturing a supported blade for use in a shaving system, comprising (a) providing a metal substrate; (b) coating at least a portion of the metal substrate with aluminum; (c) forming the metal substrate to produce a blade support; and (d) securing a blade to the blade support.

Some implementations include one or more of the following features. The coating step is performed prior to the forming step, e.g., by depositing aluminum on a sheet or strip of metal. The coating step comprises a process selected from the group consisting of PVD, CVD and plating. Coating comprises depositing a layer that is less than 5 μm thick onto a surface of the metal substrate. Coating comprises coating only one surface of the metal substrate, leaving a second surface uncoated. The securing step comprises welding.

The invention also features methods of inhibiting corrosion in shaving systems by providing an aluminum coating on at least a portion of a blade support surface.

The phrase "shaving systems," as used herein, is intended to include both disposable razors, in which a blade unit is permanently mounted on the razor handle, and systems in which the blade unit comprises a replaceable cartridge that is detachably mounted on the razor handle.

The details of one or more embodiments of the invention are set forth in the accompanying drawings and the description below. Other features and advantages of the invention will be apparent from the description and drawings, and from the claims.

DESCRIPTION OF DRAWINGS

FIG. 1 is a side view of a supported blade.

Like reference symbols in the various drawings indicate like elements.

DETAILED DESCRIPTION

Referring to FIG. 1, a supported blade 10 includes a blade 12 and a blade support 14. The blade 12 is welded to an upper portion 16 of the blade support. The blade support also includes a bent portion 18, having a radius of curvature R of about 0.05 mm to about 0.15 mm, and a lower portion 20. In some implementations, the blade support may have a thickness of from about 0.0 mm to about 0.40 mm, e.g., about 0.15 mm to about 0.30 mm. Generally, the blade is formed of steel, for example stainless steel.

The blade support may be formed of any desired metal, but is generally formed of steel, e.g., carbon steel or stainless steel. The blade support includes an aluminum coating 21 on the lower surface 22 of the blade support. Generally, the coating covers the entire lower surface of the blade support. Typically, the upper surface 23 of the blade support is not coated, as this tends to interfere with formation of the weld 24 if conventional welding techniques are used. Moreover, coating the upper surface 23 is unnecessary, due to the good conductivity from the coating 21 through the blade support to the blade, and thus would undesirably increase cost.

The coating may have any desired thickness. However, a thin coating, e.g., less than 5 μm and preferably about 2 to 3 μm, maintains the tolerance of the design and is relatively inexpensive to produce. The coating should be sufficiently thick to last for the intended life of the shaving system, for example at least 14 shaves. In some implementations it is preferred that the coating be at least 1 μm thick.

The aluminum coating may be applied by any process that will provide adequate adhesion of the coating to the underlying steel. If the coating is formed on flat sheet metal, prior to bending the blade support to the desired shape, the adhesion must be sufficient to allow the metal to be formed (e.g., by stamping) without delamination of the coating. Suitable coating methods include physical vapor deposition (PVD), chemical vapor deposition (CVD) and plating. The coating is preferably formed of substantially pure aluminum.

Cartridges or razors that include the supported blades may be tested for corrosion resistance according to ASTM G44-99. In preferred implementations, the supported blades are capable of withstanding 12 hours or more under the conditions specified in ASTM G44-99.

A number of embodiments of the invention have been described. Nevertheless, it will be understood that various modifications may be made without departing from the spirit and scope of the invention.

For example, the supported blades may be used in any desired type of razor cartridges or razors that are designed to include supported blades, including cartridges that include aluminum clips.

Accordingly, other embodiments are within the scope of the following claims.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference: the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A supported blade for use in a shaving system, the supported blade comprising:

a blade having a sharpened edge and a planar portion; and a blade support having an upper surface and a lower surface, the planar portion of the blade being mounted to a surface of the upper surface of the blade support, and the blade support having a coating on a portion of an outer surface of the blade support wherein said coating consists essentially of aluminum.

2. The supported blade of claim 1 wherein the coating is on the lower surface of the blade support.

3. The supported blade of claim 1 wherein the coating covers the entire lower surface of the blade support.

4. The supported blade of claim 1 wherein the blade support includes an upper portion to which the planar portion of the blade is mounted, a lower portion, and a bent portion between the upper and lower portions.

5. The supported blade of claim 1 wherein the aluminum coating is less than 5 μm thick.

6. The supported blade of claim 1 wherein the blade support is formed of steel.

* * * * *